US005459886A

United States Patent [19]

Payne et al.

[11] Patent Number: 5,459,886

[45] Date of Patent: Oct. 24, 1995

[54] HYDRAULIC POOL OVERFILL CONTROL

[76] Inventors: Mark Payne; Amy Payne, both of 75 Akron Rd., Lake Worth, Fla. 33467

[21] Appl. No.: 291,131

[22] Filed: Aug. 16, 1994

[51] Int. Cl.[6] ..... E04H 4/12

[52] U.S. Cl. ..... 4/508; 137/414

[58] Field of Search ..... 4/508; 137/413, 137/414, 428

[56] References Cited

U.S. PATENT DOCUMENTS

| | | | |
|---|---|---|---|
| 3,052,254 | 9/1962 | Parks | 137/414 X |
| 3,739,405 | 6/1973 | Schmidt | 4/508 |
| 4,014,052 | 3/1977 | Wolos . | |
| 4,211,249 | 7/1980 | Richards | 137/393 |
| 4,373,220 | 2/1983 | Selsted | 4/508 |
| 4,607,399 | 8/1986 | Yovanofski | 4/508 |
| 4,972,530 | 11/1990 | Snyder | 4/508 |
| 5,154,205 | 10/1992 | Langill | 137/414 X |

*Primary Examiner*—Charles E. Phillips
*Attorney, Agent, or Firm*—Alvin S. Blum

[57] ABSTRACT

A swimming pool has a recirculating pump and filter. A drain line from the high pressure side of the pump drains excess water through a hydraulically operated drain valve remote from the pool. A long narrow tube from the high pressure line drains into the pool at a float valve. When the level of water in the pool is too high, the float valve opens, and pressure in the tube drops. Pressure in the tube operates the drain valve, opening the drain valve when the level is high and the pressure is low, and closing the drain valve when the level is not high, the float valve is closed and the pressure is high. The invention may be alternatively practiced with a drain valve that is opened by a high control pressure using a float valve that closes when the pool level is high. A timer controlled valve in the tube prevents opening the drain valve during preselected times when the pool is occupied.

6 Claims, 1 Drawing Sheet

HYDRAULIC POOL OVERFILL CONTROL

BACKGROUND OF THE INVENTION

The present invention relates to liquid level controls and, more particularly, to a system for pumping excess water from a swimming pool which employs a hydraulic control mechanism.

Swimming pools are designed to operate most effectively when the water level in the pool is maintained at a predetermined level. A gutter surrounds the water and a skimmer mechanism aspirates water from the gutter, through a coarse filter and into the main filter/recirculating system. When the water level is correctly maintained, this mechanism effectively removes leaves, insects and floating debris from the pool. After a rainfall, the water level may be so high that the floating debris is no longer removed by this skimmer mechanism. It will then be a task to pump out the excess water and clean any clinging debris off the pool walls. Electrically operated level control devices are well known in the art. A float switch at the pool applies electric power to a pump or to an electrically actuated valve when the level gets high so that water is pumped to a drain until a predetermined level is reached. Several problems are presented by these devices. When the pool is in use, the level will rise from displacement and water motion from activity will trigger drainage of water erroneously that must later be added and the pool will be too low for proper skimming. The system may then be adding and draining water continuously. Furthermore, electric current at or near the pool is a shock hazard, and electric switch contacts in the corrosive chlorine environment are trouble prone.

SUMMARY OF THE INVENTION

It is accordingly an object of the invention to provide a pool overfill control system without electric lines, power or switch contacts at the pool. It is another object to provide such a system that is unresponsive to false signals from people using the pool.

The control system of the invention comprises a branch line from the high pressure side of the circulating pump to a drain. A hydraulically operated valve in the drain line is controlled by the pressure in a control tube carrying water from the high pressure pipe to a remotely located float valve at the pool. When pressure in the control tube is high, the drain valve is closed. When pressure in the control tube is low, the drain valve opens and some pool water is drained. The float valve at the terminus of the control tube opens when the level is high, water drains from the control tube into the pool, pressure in the control tube is low, opening the drain valve. When the pool level drops to normal, the float valve closes, pressure rises in the control tube and drain valve shuts off.

A timer controlled valve in the control tube line between the drain valve and the float valve closes off the control tube at times when the pool may be occupied so that the automatic overfill control will be inactivated.

These and other objects, advantages and features of the invention will become more apparent when the detailed description is studied in conjunction with the drawings.

DETAILED DESCRIPTION OF PREFERRED EMBODIMENTS

The liquid reservoir or pool has attached to it a liquid level responsive valve which provides an open condition or a closed condition, either a first condition when the level of liquid is too high or a second condition when the level is not too high. The valve is connected by a long tube to the high pressure side of the circulating pump. This tube also connects with a hydraulically controlled valve interposed between the high pressure side and a drain to waste. The pressure in this tube controls the hydraulically controlled valve to thereby drain water when the level is too high, because the level responsive valve determines the control pressure at the drain valve. By providing only mechanical and hydraulic apparatus, but no electrical apparatus at the pool, many problems of the prior art are overcome. Only a single narrow tube from the pool provides the necessary control.

Figure 1:
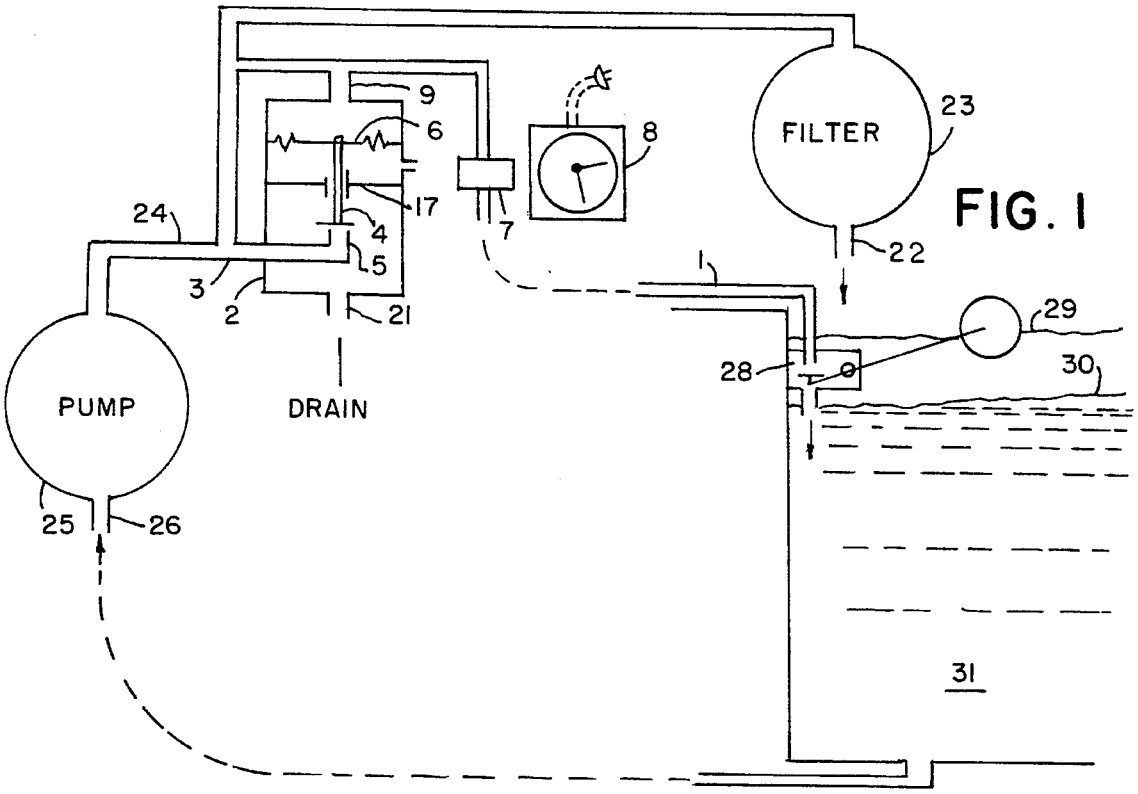
FIG. 1 is a schematic drawing of the control system of the invention.

Referring now first to FIG. 1, a pool 31 or surge tank connected to a pool, has a desired water level 30 at which the skimmer mechanism operates most effectively and an overfull water level 29 which must be lowered for effective operation. A recirculating filter system of the type well known in the art comprises a recirculating pump 25 with intake pipe 26 from the pool and high pressure output 24 to filter 23 and return pipe 22.

The automatic overfill drain control system of the invention includes a sensor 28 of water level which may, for example, be in the form of a float valve attached to the pool which opens when level 29 is reached and closes when level 30 is reached. Valve 28 receives pressurized water through long, narrow tube 1 from pump output pipe 24. When the pool level is high, valve 25 is open, and pressure in tube 1 is low. Also connected to pump output pipe 24 is a drain line 21 to waste. Interposed in this drain line is a hydraulically actuated valve 2 which is controlled by the pressure in tube 1 connected to the float valve 25. When the level is high at level 29 the valve 28 is open, water flows through line 1 to the pool, pressure remains low in line 1 at control conduit 9 at valve 2, which causes valve 2 to remain open, causing water entering valve 2 at valve input 3 to pass through to drain 21. When sufficient water has been pumped out, the pool level 30 will be reached, the float valve 25 will close, pressure will rise in line 1, closing valve 2 so that no more water flows through drain line 21.

Hydraulically actuated valve 2 is an example of a hydraulically actuated valve which may take many forms. A movable valve member 4 seals off valve seat 5 when diaphragm 6 is forced down by pressure in line 1. Valve member 4 is slidably sealed in support 17. When pressure in line 1 falls, pressure from input 3 forces valve member 4 and diagram 6 upward, opening the valve and draining water to waste through line 21.

In order to avoid draining water when the pool is not overfull, but is only responding to occupants in the pool, a solenoid valve 7 is interposed in line 1 that is energized by timer 8 which may be set to close line 1 during hours of anticipated occupancy. This will keep pressure high at the control conduit 9 to the valve 2 to prevent its opening and inadvertently draining water.

Figure 2:
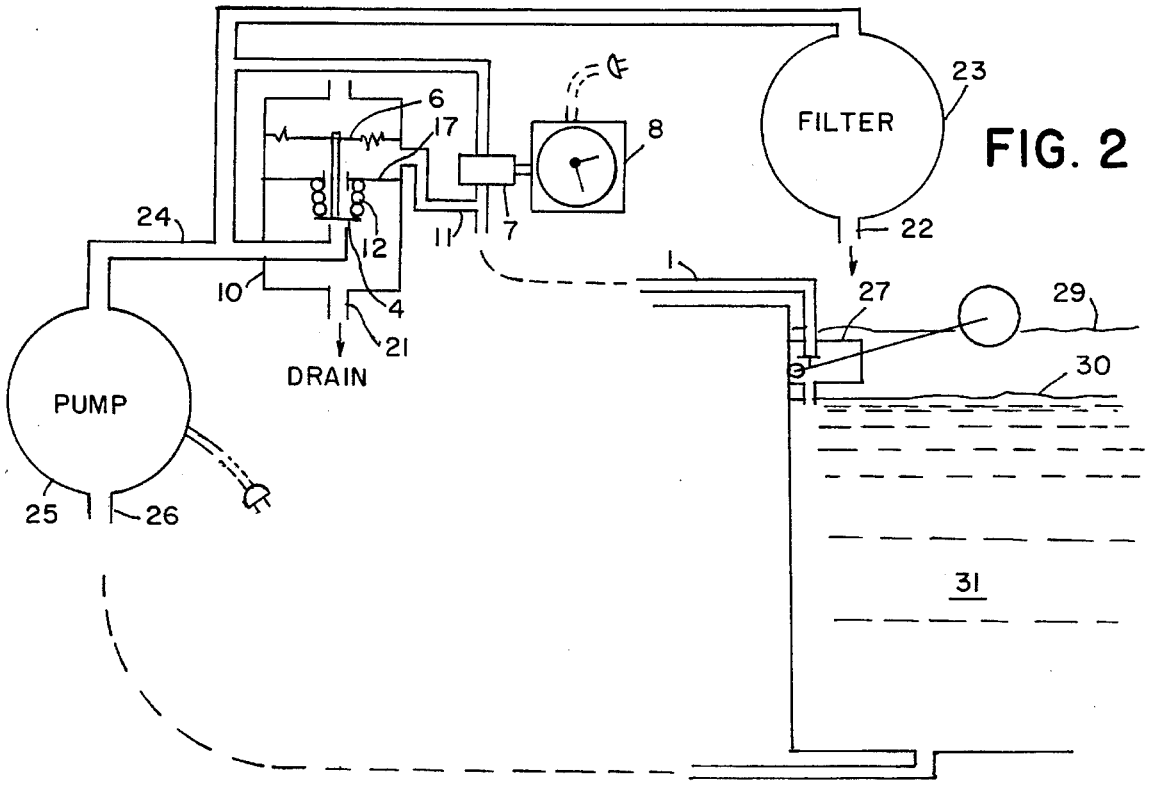
FIG. 2 is a schematic drawing of another embodiment of the invention.

FIG. 2 shows an alternative embodiment using a float valve 27 which closes when the level is high and a hydraulically operated drain valve 10, held normally closed by spring 12, opens when pressure is high at control input line 11. With this arrangement, an overfull level 29 close s valve 27, pressure rise s in line 1 and input 11, valve 10 opens, and water drains through line 21. This embodiment will not drain the pool if line 1 leaks or is cut. The timer controlled solenoid valve 7 is positioned so that when it is closed, pressure at control line 11 will always be low, regardless of float valve 27 condition. Then the occupancy of the pool will not erroneously cause drainage.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

We claim:

1. Control apparatus for draining excess liquid from a liquid reservoir that is equipped with a recirculating pump having a low pressure input from the reservoir and a high pressure outlet return pipe to said reservoir, the control apparatus comprising:

A) liquid level responsive valve means attached to said reservoir for providing either, an open valve condition or a closed valve condition, in which one of said open and closed conditions is provided when said level is high, and the other of said open and closed conditions is provided when said level is not high;

B) a long, narrow, tubular liquid connection between said liquid level responsive valve means and said return pipe;

C) a drain pipe connecting said return pipe to a drain;

D) hydraulically operated valving means interposed in said drain pipe for opening to drain liquid when said level is high; and E) a control liquid conduit between said tubular connection and said valving means arranged so that fluid pressure in said conduit, being affected by said liquid level responsive valve means, will open said valving means and drain liquid when said level is high and close said valving means when said level is not high.

2. The control apparatus according to claim 1 further comprising a timer controlled valve connected in said tubular connection and arranged for preventing opening of said valving means during preselected times.

3. Control apparatus for draining excess liquid from a liquid reservoir that is equipped with a recirculating pump having a low pressure input from the reservoir and a high pressure outlet return pipe to said reservoir, the control apparatus comprising:

A) liquid level responsive valve means attached to said reservoir for providing an open condition when said level is high and a closed condition when said level is not high;

B) a long, narrow, tubular liquid connection between said liquid level responsive valve means and said return pipe;

C) a drain pipe connecting said return pipe to a drain;

D) hydraulically operated valving means interposed in said drain pipe for opening to drain liquid when said level is high; and E) a control liquid conduit between said tubular liquid connection and said valving means for hydraulically operating said valving means by pressure in said liquid connection, wherein reduced pressure caused by a high level opening said level responsive .valve means will cause said valving means to open and thereby drain liquid and a not high level closing said level responsive valve means and elevating pressure at said conduit to close said valving means and stop draining liquid.

4. The control apparatus according to claim 3 further comprising a timer controlled valve connected in said tubular connection and arranged for maintaining pressure in said conduit for preventing opening of said valving means during preselected times.

5. Control apparatus for draining excess liquid from a liquid reservoir that is equipped with a recirculating pump having a low pressure input from the reservoir and a high pressure outlet return pipe to said reservoir, the control apparatus comprising:

A) liquid level responsive valve means attached to said reservoir for providing a closed condition when said level is high and an open condition when said level is not high;

B) a long, narrow, tubular liquid connection between said liquid level responsive valve means and said return pipe;

C) a drain pipe connecting said return pipe to a drain;

D) hydraulically operated valving means interposed in said drain pipe for opening to drain liquid when said level is too high; and E) a control liquid conduit between said tubular liquid connection and said hydraulically operated valving means for hydraulically operating said valving means by pressure in said liquid connection, wherein elevated pressure caused by a high liquid level closing said level responsive valve means will open said hydraulically operated valving means and drain liquid, and a not high level will open said level sensitive valve means, reduce pressure at said conduit and close the valving means to prevent drainage of liquid.

6. The control apparatus according to claim 5 further comprising a timer controlled valve connected in said tubular connection and arranged for reducing pressure in said conduit for preventing opening of said valving means and drainage during preselected times.

* * * * *